US009936801B1

(12) United States Patent
Allen et al.

(10) Patent No.: US 9,936,801 B1
(45) Date of Patent: Apr. 10, 2018

(54) TRANSFORMABLE BALCONY TABLE

(71) Applicants: Scott Allen, Kihei, HI (US); Janet Allen, Kihei, HI (US)

(72) Inventors: Scott Allen, Kihei, HI (US); Janet Allen, Kihei, HI (US)

( * ) Notice: Subject to any disclaimer, the term of this patent is extended or adjusted under 35 U.S.C. 154(b) by 0 days.

(21) Appl. No.: 15/368,811

(22) Filed: Dec. 5, 2016

Related U.S. Application Data

(63) Continuation-in-part of application No. 29/581,813, filed on Oct. 21, 2016, and a continuation-in-part of application No. 29/580,162, filed on Oct. 6, 2016.

(51) Int. Cl.

| | |
|---|---|
| ***A47B 23/00*** | (2006.01) |
| ***A47B 13/08*** | (2006.01) |
| ***A47B 13/10*** | (2006.01) |
| ***A47B 1/04*** | (2006.01) |
| ***A47B 5/02*** | (2006.01) |
| ***A47B 37/00*** | (2006.01) |

(52) U.S. Cl.
CPC ..... *A47B 13/088* (2013.01); *A47B 1/04* (2013.01); *A47B 5/02* (2013.01); *A47B 13/10* (2013.01); *A47B 37/00* (2013.01)

(58) Field of Classification Search
CPC ..... A47B 96/022; A47B 5/00; A47B 57/045
USPC ..... 108/42, 152, 65, 66; 248/456, 242, 235, 248/250
See application file for complete search history.

(56) References Cited

U.S. PATENT DOCUMENTS

| | | | | | |
|---|---|---|---|---|---|
| 1,599,654 | A | * | 9/1926 | Cranston | A47B 96/022 211/153 |
| 1,607,887 | A | * | 11/1926 | Fowler | A47B 57/045 182/62 |
| 2,582,557 | A | * | 1/1952 | Palkman | A47B 96/022 108/42 |
| 2,697,019 | A | * | 12/1954 | Stefan | A47J 47/20 108/27 |
| 4,360,181 | A | * | 11/1982 | Burkholder | A47B 96/061 108/108 |
| 4,374,498 | A | * | 2/1983 | Yellin | A47B 55/02 108/152 |
| 4,518,140 | A | * | 5/1985 | Ferranto | A47B 97/08 108/32 |
| 4,805,863 | A | * | 2/1989 | Armstrong | A47B 96/061 108/108 |
| 4,886,236 | A | * | 12/1989 | Randall | A47B 96/022 108/152 |
| 4,889,057 | A | | 12/1989 | Chartrand | |

(Continued)

*Primary Examiner* — Jose V Chen
(74) *Attorney, Agent, or Firm* — Dale J. Ream

(57) ABSTRACT

A transformable balcony table capable of attachment to a balcony rail includes a primary table assembly including a table top having a rear edge and a pair of side edges extending forwardly from the rear edge so as to form an apex opposite the rear edge The primary table assembly includes a mounting portion extending downwardly from the rear edge of the table top and defining a plurality of holes. A first stability member having a proximal end is removably coupled to the bottom surface and extends downwardly and rearwardly to a distal end. A fastener is selectively inserted through the slots of the mounting portion for coupling the mounting portion to the balcony rail. The balcony table includes a first and second leaf selectively coupled to respective side edges of the table top, the leaves transforming the table from two eating places to four.

20 Claims, 16 Drawing Sheets

(56) References Cited

U.S. PATENT DOCUMENTS 4,998,484 A * 3/1991 Groetzinger ..... A47B 5/04 108/115
5,381,738 A * 1/1995 Meyer ..... A47B 5/00 108/108
5,528,993 A * 6/1996 Vincelli ..... A47B 5/06 108/42
5,603,267 A * 2/1997 Soper ..... A47B 3/00 108/116
6,382,109 B1 * 5/2002 Novikoff ..... A47B 87/002 108/65
6,779,467 B1 * 8/2004 McCoy ..... A47B 5/04 108/134
6,931,998 B1 * 8/2005 Leese ..... A47B 5/02 108/152
7,210,414 B1 * 5/2007 Barone ..... A47B 5/00 108/152
7,966,948 B1 * 6/2011 Galietti ..... A47B 3/00 108/134
8,015,929 B2 * 9/2011 Tyner ..... A47B 23/025 108/134
8,561,550 B2 * 10/2013 Raml ..... A47B 5/00 108/152
2006/0162623 A1 * 7/2006 Ciulla ..... A47B 5/06 108/48
2007/0101908 A1 5/2007 Makita
2007/0145213 A1 6/2007 Fischer
2009/0308287 A1 * 12/2009 Chen ..... A47B 5/04 108/42
2010/0101459 A1 * 4/2010 Nelson ..... A47B 5/04 108/47
2013/0161463 A1 * 6/2013 Toms ..... A47C 1/126 248/240.4
2016/0037906 A1 * 2/2016 Knight ..... A47B 5/04 108/42

* cited by examiner

TRANSFORMABLE BALCONY TABLE

REFERENCE TO RELATED APPLICATIONS

This application claims the benefit of application U.S. Ser. No. 29/581,813 filed Oct. 21, 2016 titled Balcony Table, and application U.S. Ser. No. 29/580,162 filed Sep. 6, 2016 titled Rail Mounted Food and Beverage Platform, which are incorporated herein by reference.

BACKGROUND OF THE INVENTION

This invention relates generally to furniture for dining and, more particularly, to a table configured for attachment to the bars and railing of a balcony rail assembly and that may be transformed from a two station (i.e. table for two) to a four station (i.e. table for 4) configuration.

Traditional patio furniture is designed and constructed with a patio function that when used on a balcony results in a person's view being hindered by the balcony rail. Specifically, traditional patio furniture is not height adjustable relative to a railing nor easily changed between two seat dining to four seat dining. In addition, traditional patio furniture is supported by traditional table legs which can be inconveniently in the way as users shift positions about the table. By contrast, balcony tables that have no vertical leg whatsoever are often flimsy and unstable.

Therefore, it would be desirable to have a transformable balcony table that may be coupled at a desired height to the bars of a balcony rail assembly. Further, it would be desirable to have a transformable balcony table having at least one stability member that may be leveraged between the bars of a railing assembly and a plurality of stop members under a tabletop so as to adjust the height of the table top as desired by a user. For instance, users of the table may choose between the height of a countertop and being seated upon counter stools versus the height of a traditional table and being seated upon chairs. In addition, it would be desirable to have a transformable balcony table that is transformable between a table-for-two configuration and a table-for-four configuration by the addition of two outer leaves.

SUMMARY OF THE INVENTION

A transformable balcony table capable of attachment to a balcony rail according to the present invention includes a primary table assembly including a table top having a rear edge and a pair of side edges extending forwardly from the rear edge so as to form an apex opposite the rear edge. The primary table assembly includes a mounting portion extending downwardly from the rear edge of the table top and defining a plurality of holes. A first stability member having a proximal end is removably coupled to the bottom surface and extending downwardly and rearwardly to a distal end. A fastener is selectively inserted through selected holes of the mounting portion for coupling the mounting portion to the balcony rail. The balcony table includes a first and second leaf selectively coupled to respective side edges of the table top, the leaves transforming the table from two eating stations to four.

Therefore, a general object of this invention is to provide a transformable balcony table selectively coupled to the bars of a balcony rail assembly at a desired height.

Another object of this invention is to provide a transformable balcony table, as aforesaid, having one or more stability members that may be leveraged at rearwardly ascending angle between a bottom of the bars of the rail assembly and a selectable position on the bottom of a tabletop, whereby to adjust a height thereof.

Still another object of this invention is to provide a transformable balcony table, as aforesaid, that may be coupled to the bars of a rail assembly with a U-bolt or similar fastener.

Yet another object of this invention is to provide a transformable balcony table, as aforesaid, that is transformable quickly and easily between a table-for-two and a table-for-four.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
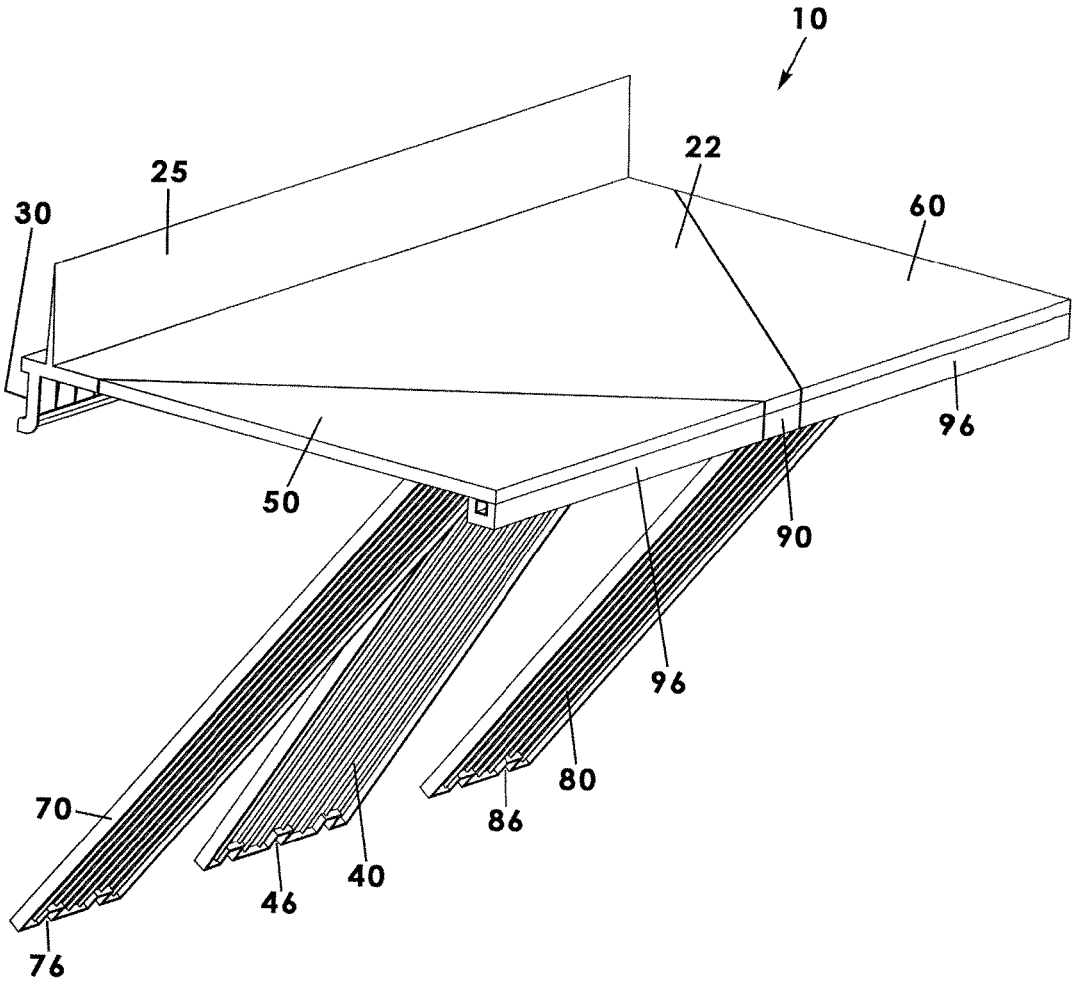
FIG. 1 is a perspective view of a transformable balcony table according to a preferred embodiment of the present invention.
Figure 2:
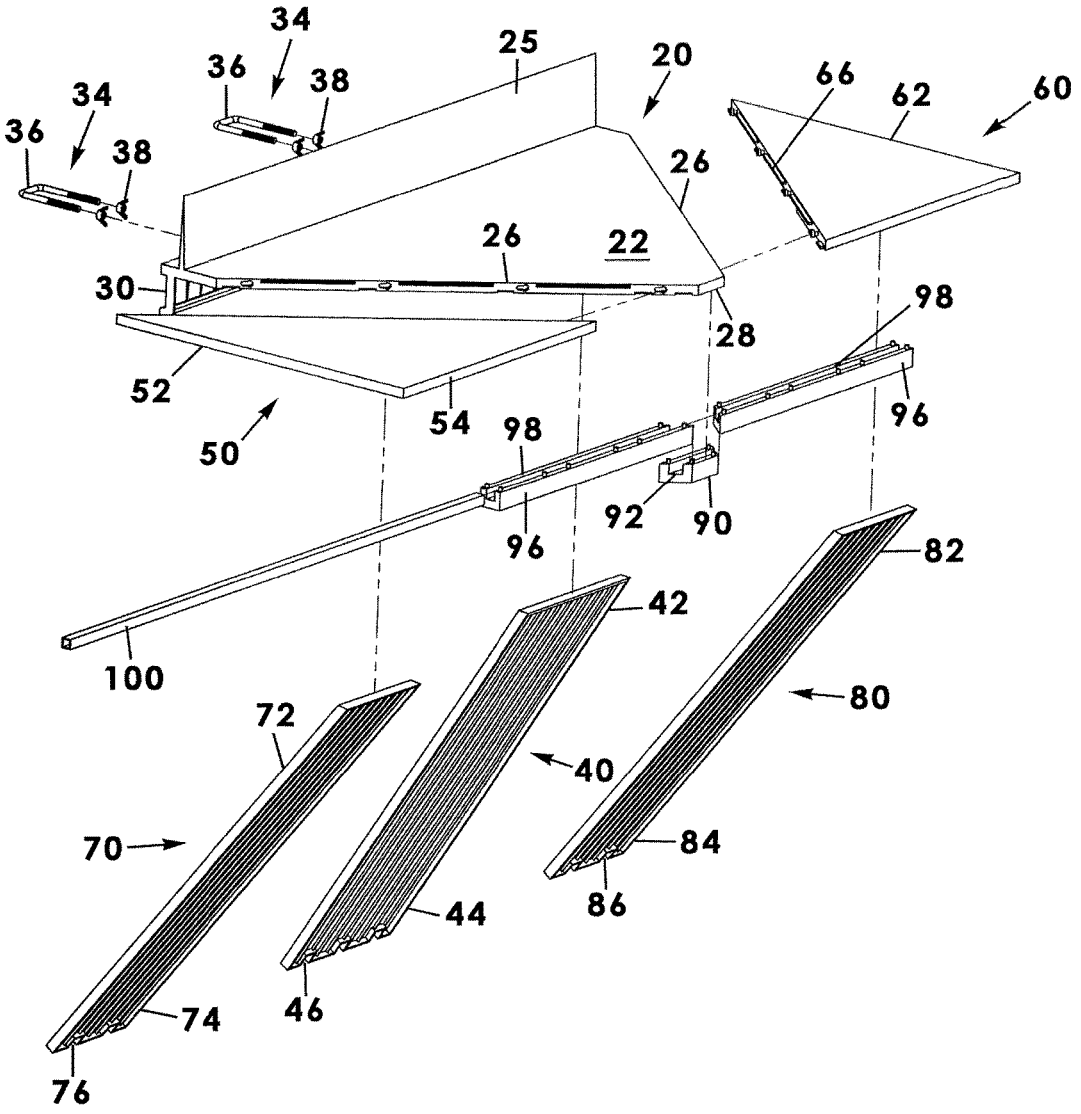
FIG. 2 is an exploded view of the balcony table as in FIG. 1.
Figure 3:
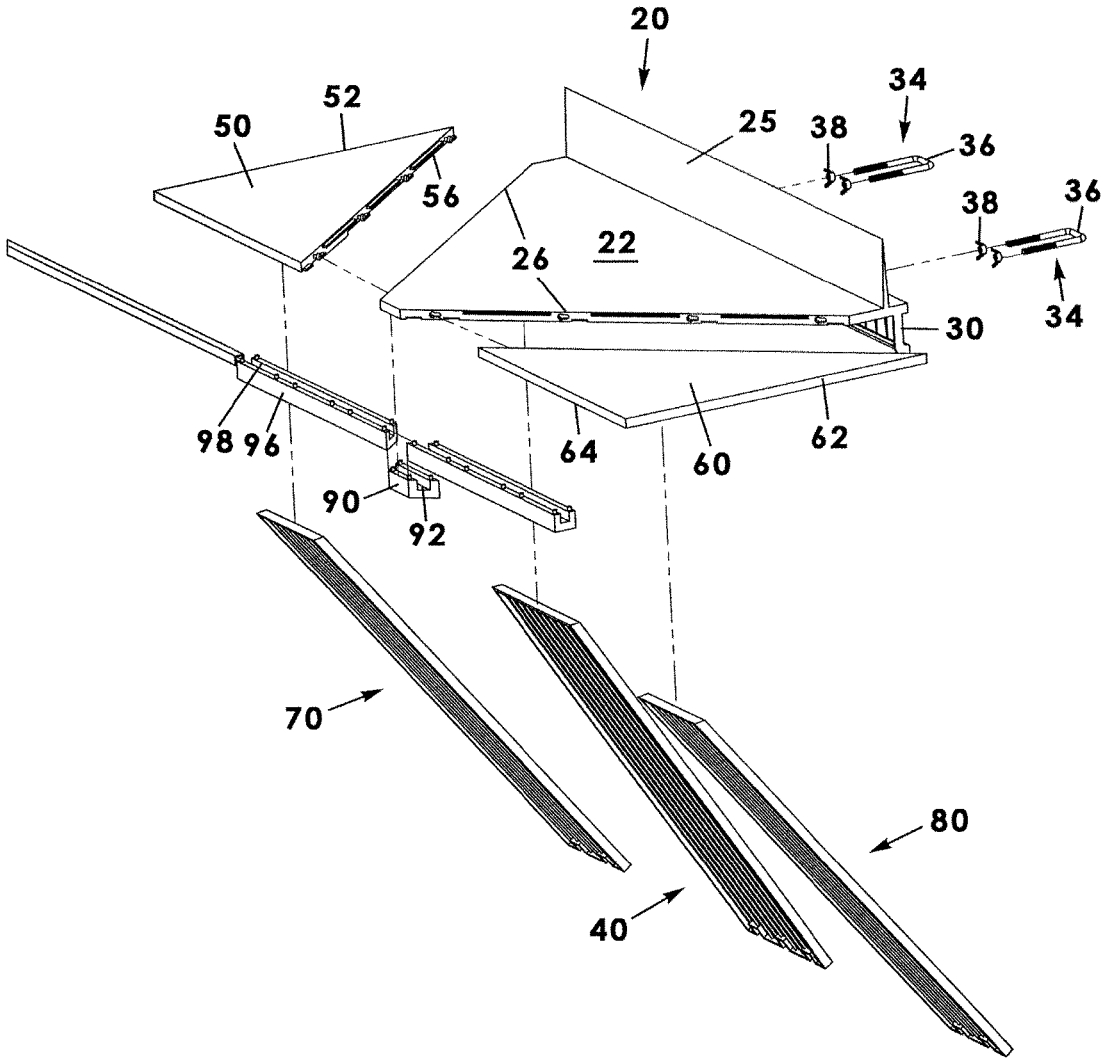
FIG. 3 is an exploded view from another angle of the balcony table as in FIG. 1.

A transformable balcony table according to a preferred embodiment of the present invention will now be described in detail with reference to FIGS. 1 to 13 of the accompanying drawings. The transformable balcony table 10 includes a primary table assembly 20 having a tabletop 22, mounting portion 30, and a first stability member 40 configured for attachment to upstanding bars of a balcony rail assembly 12. The transformable balcony table 10 may also include a first leaf 50 and second leaf 60 that effectively doubles the number of eating stations.

The primary table assembly 20 includes a tabletop 22 having a rear edge 24 and a pair of opposed side edges 26 extending forwardly from the rear edge 24 such that the edges of the tabletop 22 collectively define a generally triangular configuration. The side edges 26 converge forwardly to form an apex 28 displaced from the rear edge 24. Preferably, the tabletop 22 has a smooth planar configuration and, when mounted to a balcony rail, is horizontal and parallel to a balcony floor surface. The primary table assembly 20 may include a backsplash 25 upwardly extending from the rear edge 24 of the tabletop 22 and, preferably, perpendicular to the tabletop 22. In an embodiment, the backsplash 25 may have a rectangular configuration although other configurations would also work. The backsplash 25 may include an ornamental appearance, such as a decorative tile arrangement.

Figure 5:
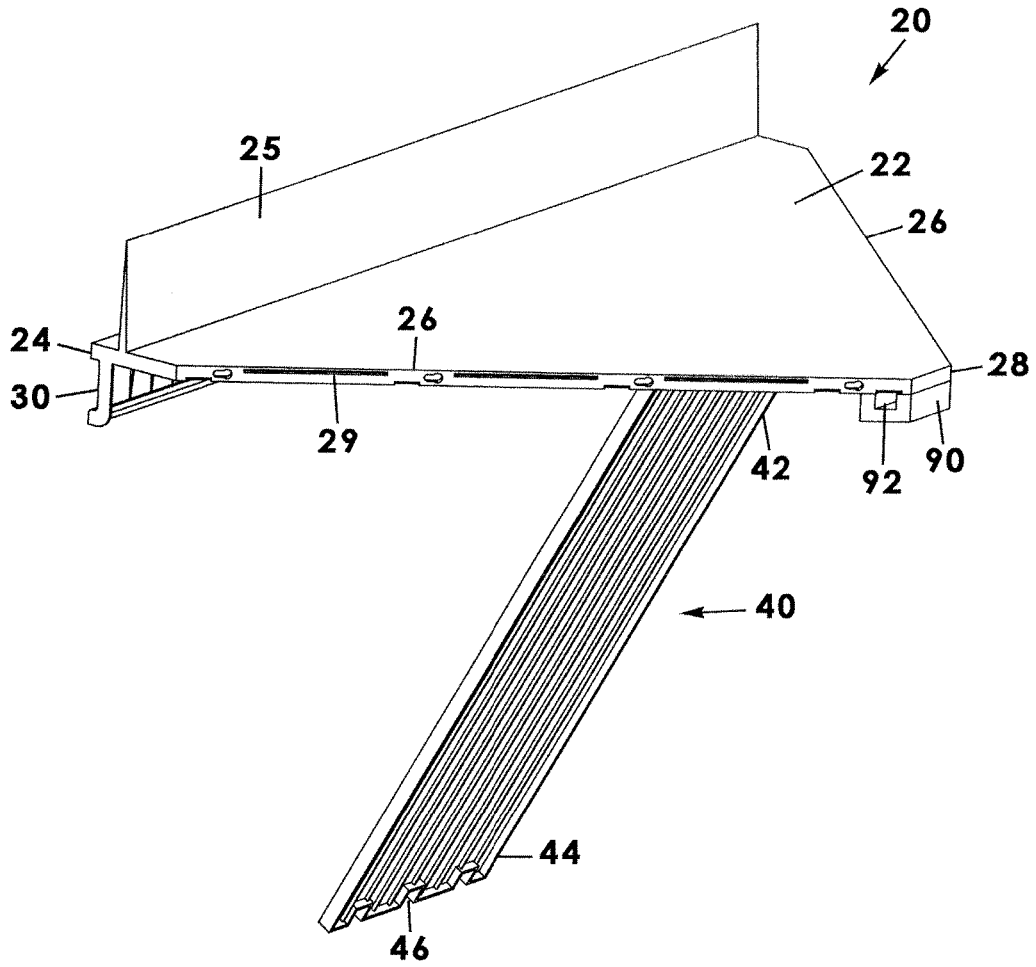
FIG. 5 is am elevated perspective view of the transformable balcony table with the first and second leaves removed.
Figure 6:
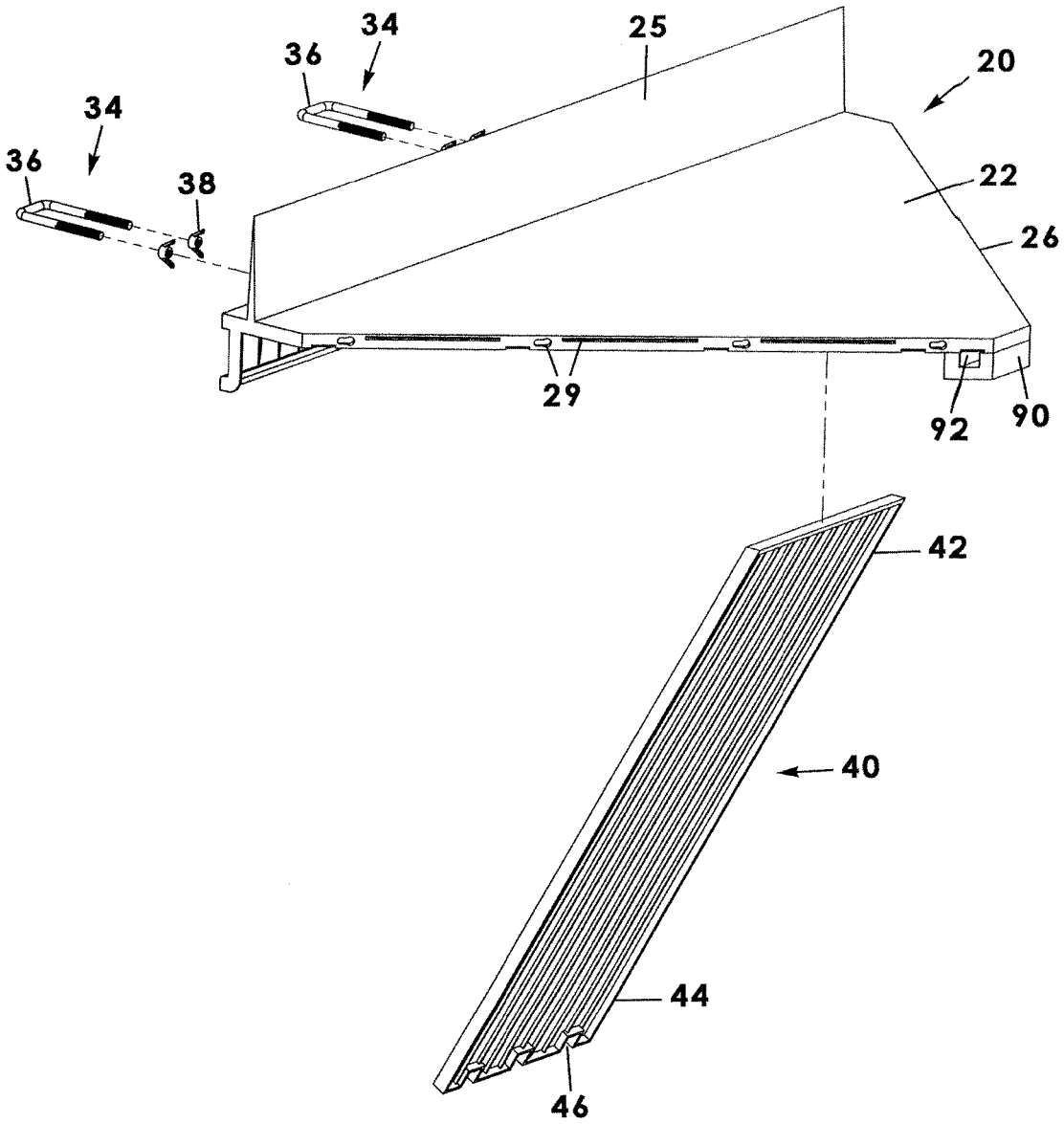
FIG. 6 is an exploded view of the balcony table shown in FIG. 5.
Figure 7:
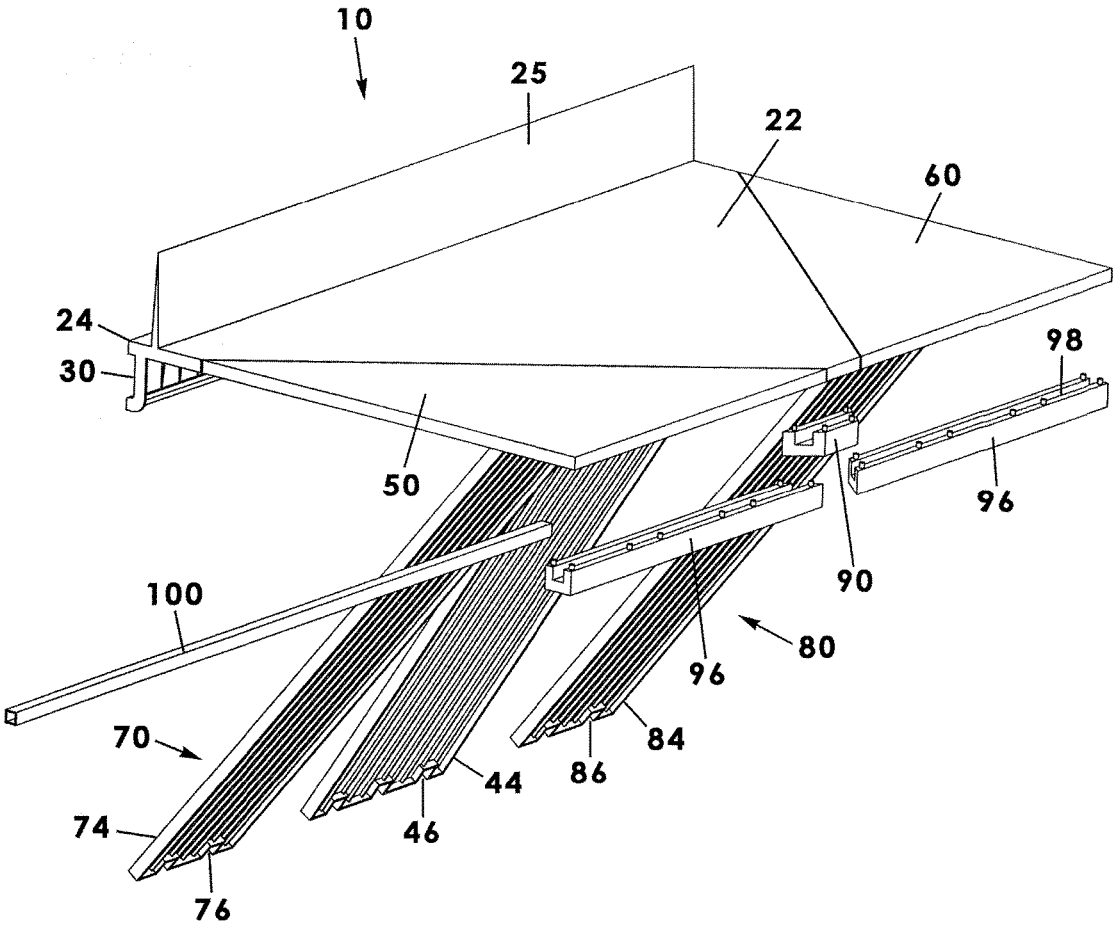
FIG. 7 is a partially exploded view of the balcony table as in FIG. 1 illustrating respective locking blocks and locking rod in a disassembled configuration.
Figure 8:
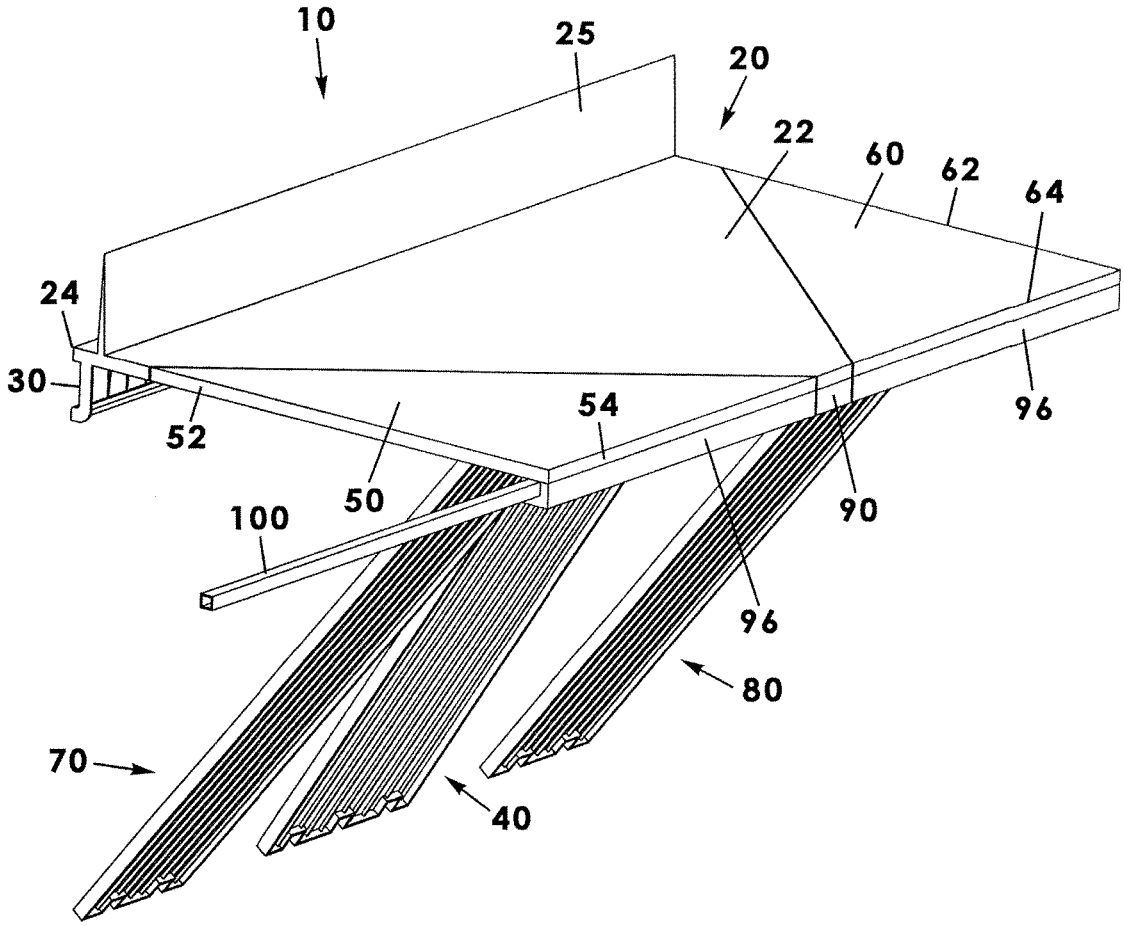
FIG. 8 is another partially exploded view of the balcony table as in FIG. 7 illustrating respective locking blocks and locking rod in a partially assembled and deployed configuration.
Figure 9A:
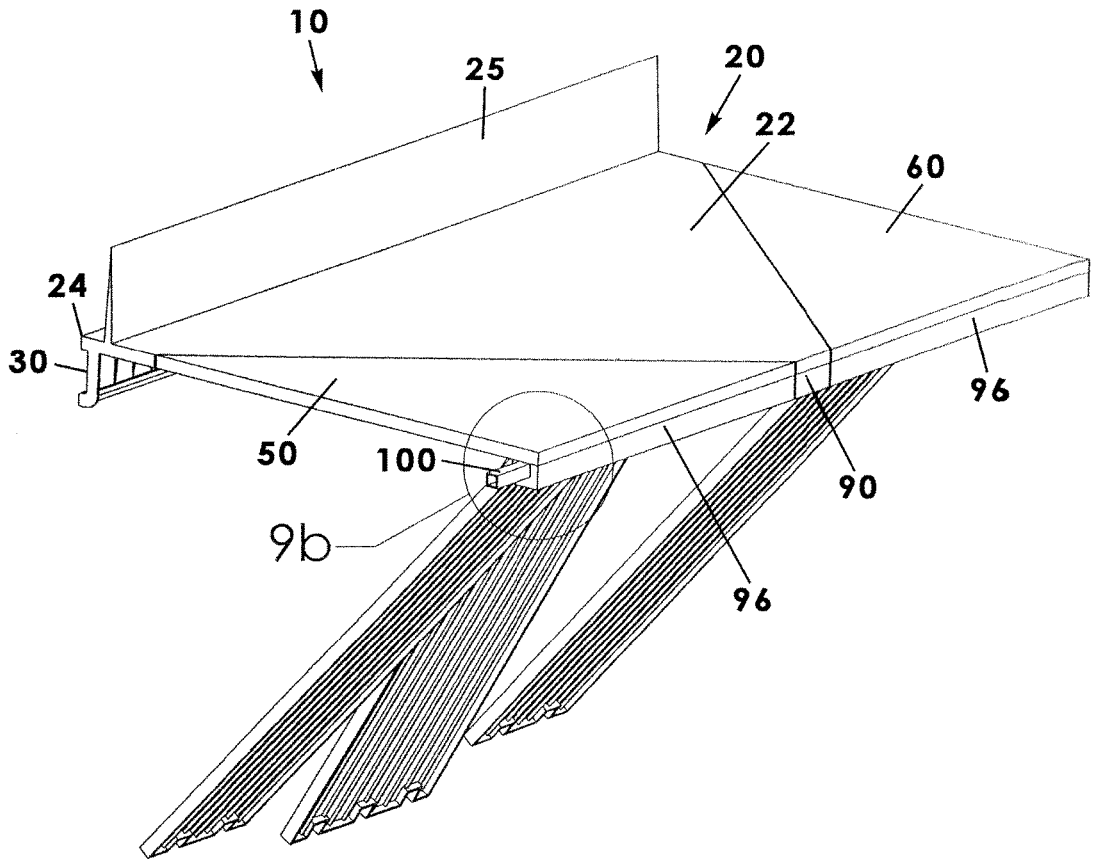
FIG. 9*a* is another partially exploded view of the balcony table as in FIG. 7 illustrating respective locking blocks and locking rod in a partially assembled and deployed configuration.
Figure 9B:
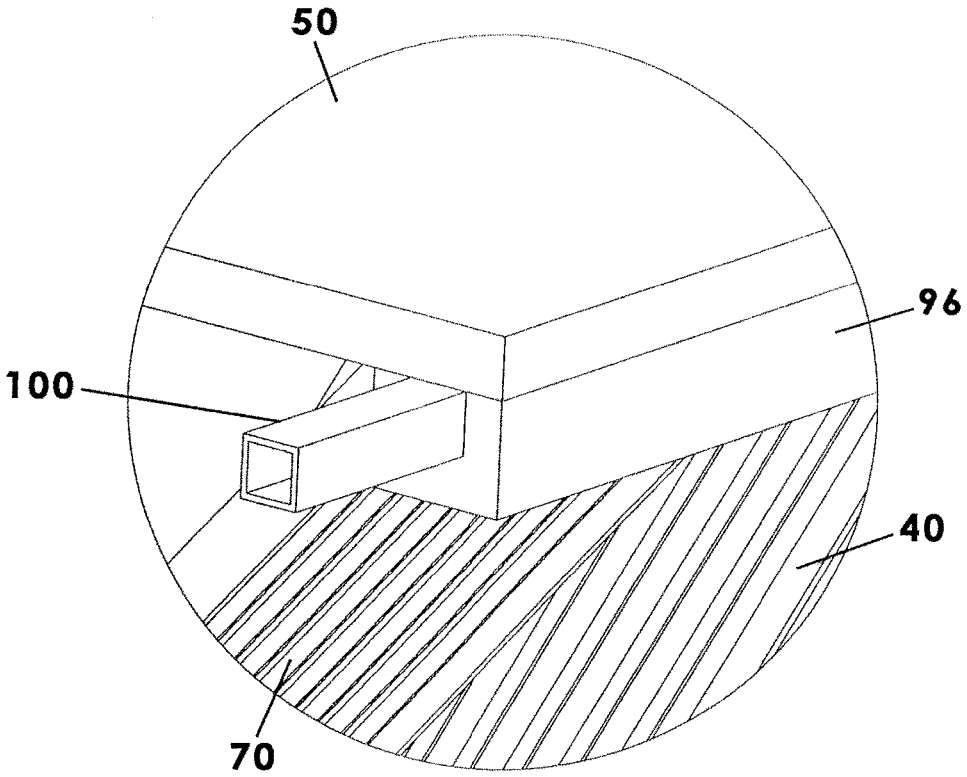
FIG. 9*b* is an isolated view on an enlarged scale taken from FIG. 9*a;*
Figure 10A:
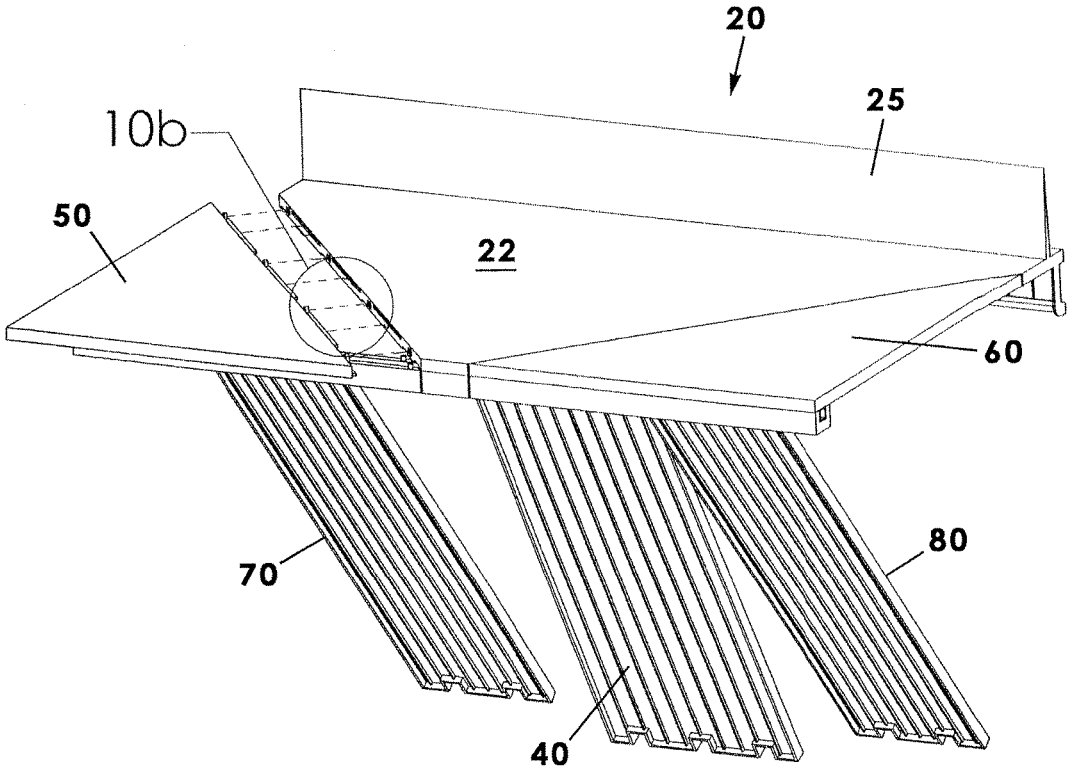
FIG. 10*a* is a partially exploded view taken from FIG. 1 illustrating the tongue and groove configuration of a first leaf being coupled to the tabletop.
Figure 10B:
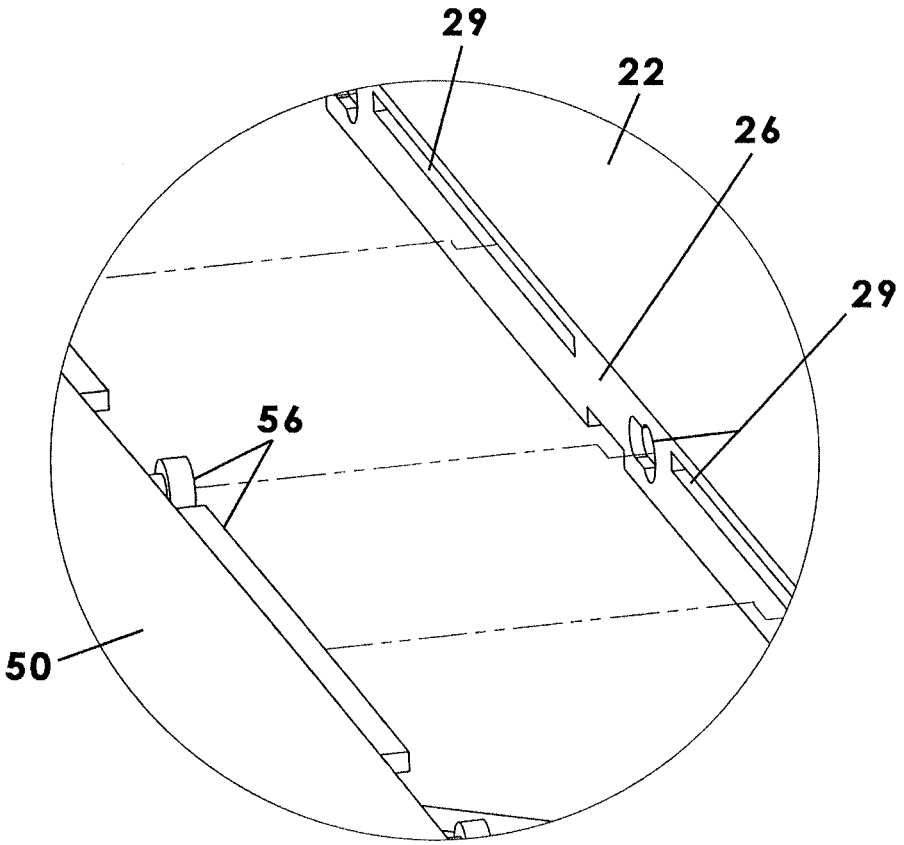
FIG. 10*b* is an isolated view on an enlarged scale taken from FIG. 10*a;*
Figure 11A:
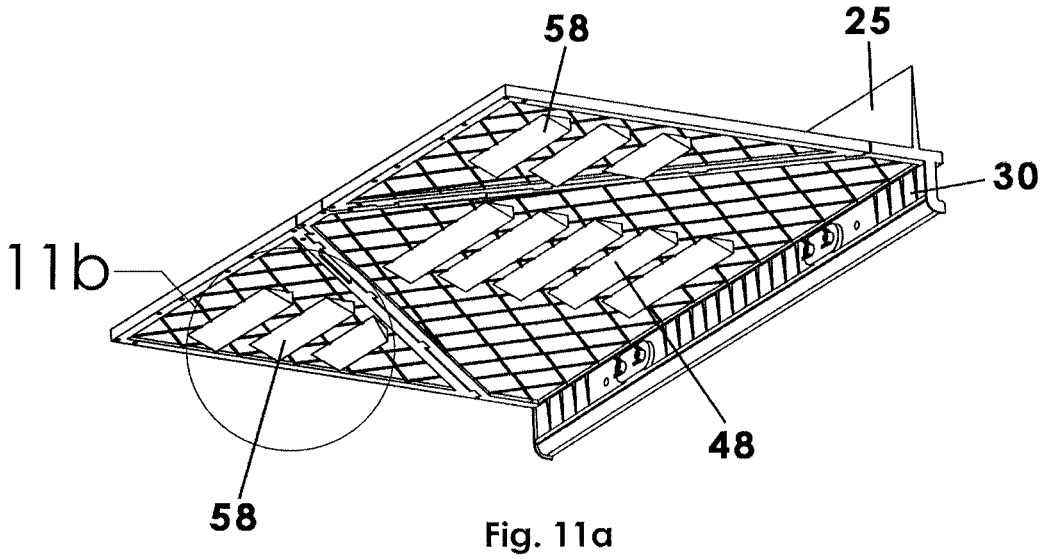
FIG. 11*a* is a perspective view from a lower angle of the balcony table as in FIG. 1.
Figure 11B:
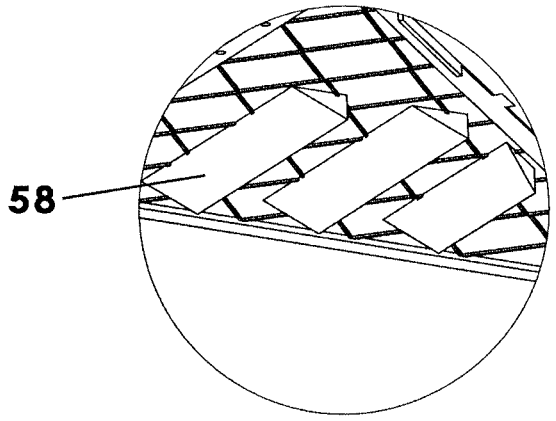
FIG. 11*b* is an isolated view on an enlarged scale taken from FIG. 11*a;*

The primary table assembly 20 includes a mounting portion 30 coupled to the rear edge 24 and extending downwardly therefrom (FIGS. 5 and 11*a*). The mounting portion 30 may extend the width of the rear edge 24 and may define a plurality of holes 32 configured for receiving a fastener 34. In an embodiment, the mounting portion 30 may be perpendicular to the tabletop 22. The mounting portion 30 is intended to be positioned inwardly adjacent the vertical bars 14 of a balcony rail assembly 12 such that the mounting portion 30 may be coupled thereto as discussed below.

Figure 4A:
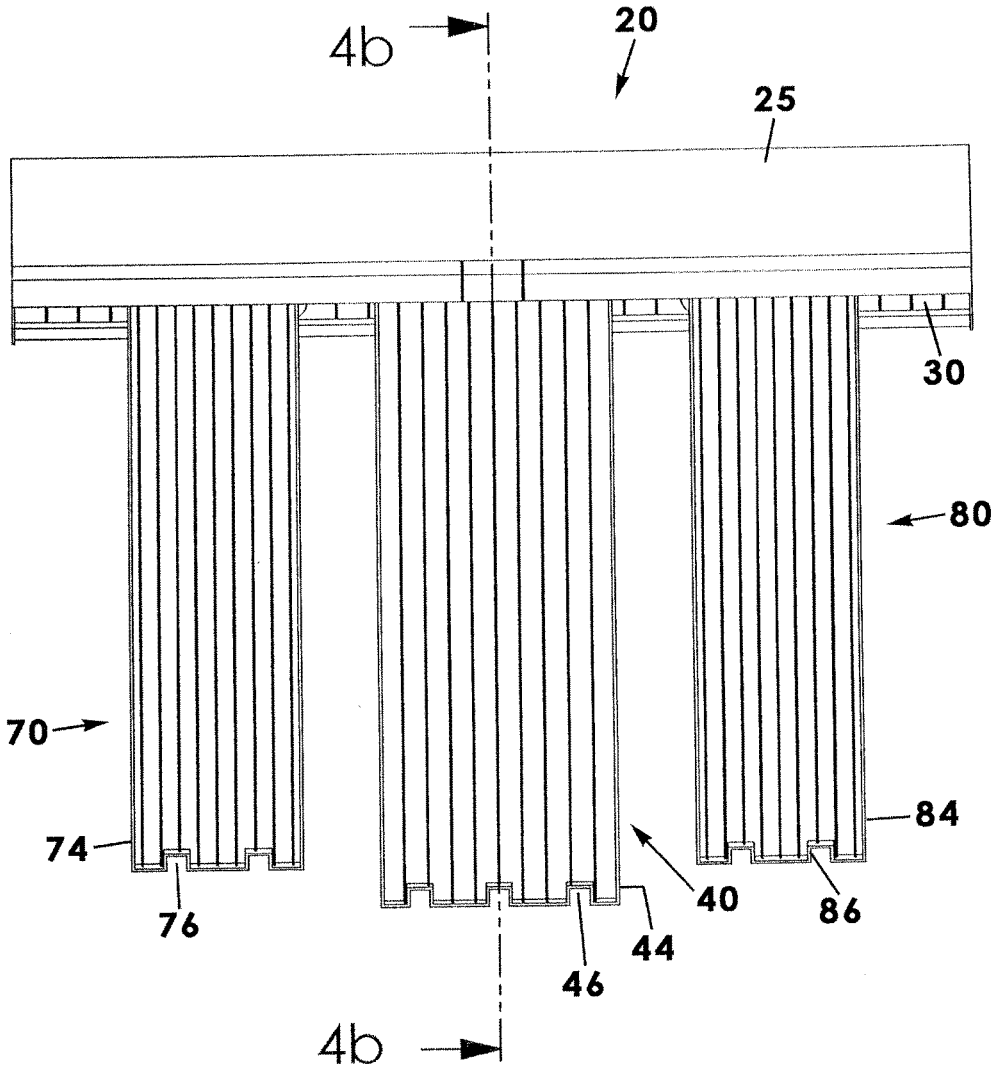
FIG. 4*a* is a front view of the balcony table as in FIG. 1.
Figure 4B:
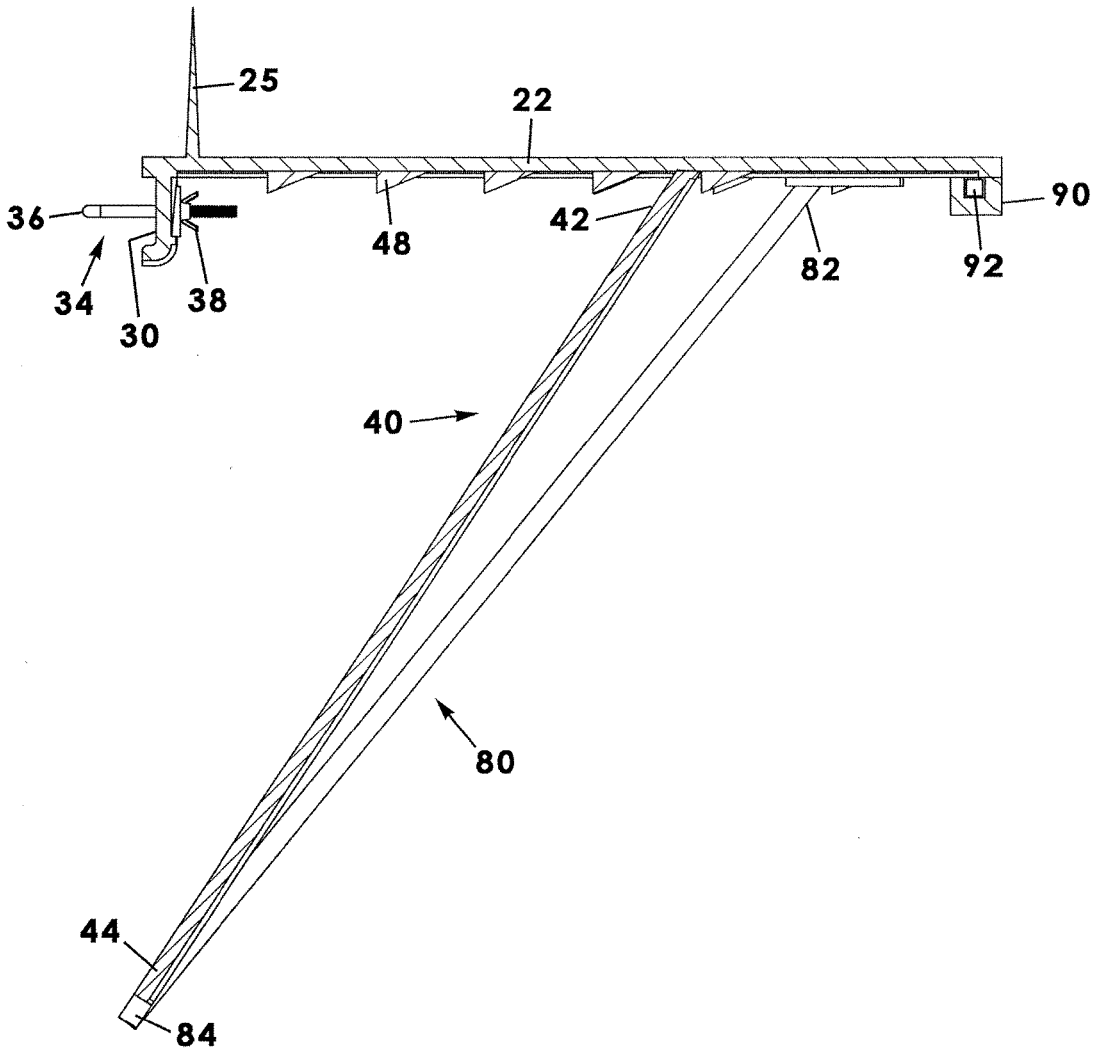
FIG. 4*b* is a sectional view taken along lines 4*b*-4*b* from FIG. 4*a;*
Figure 12A:
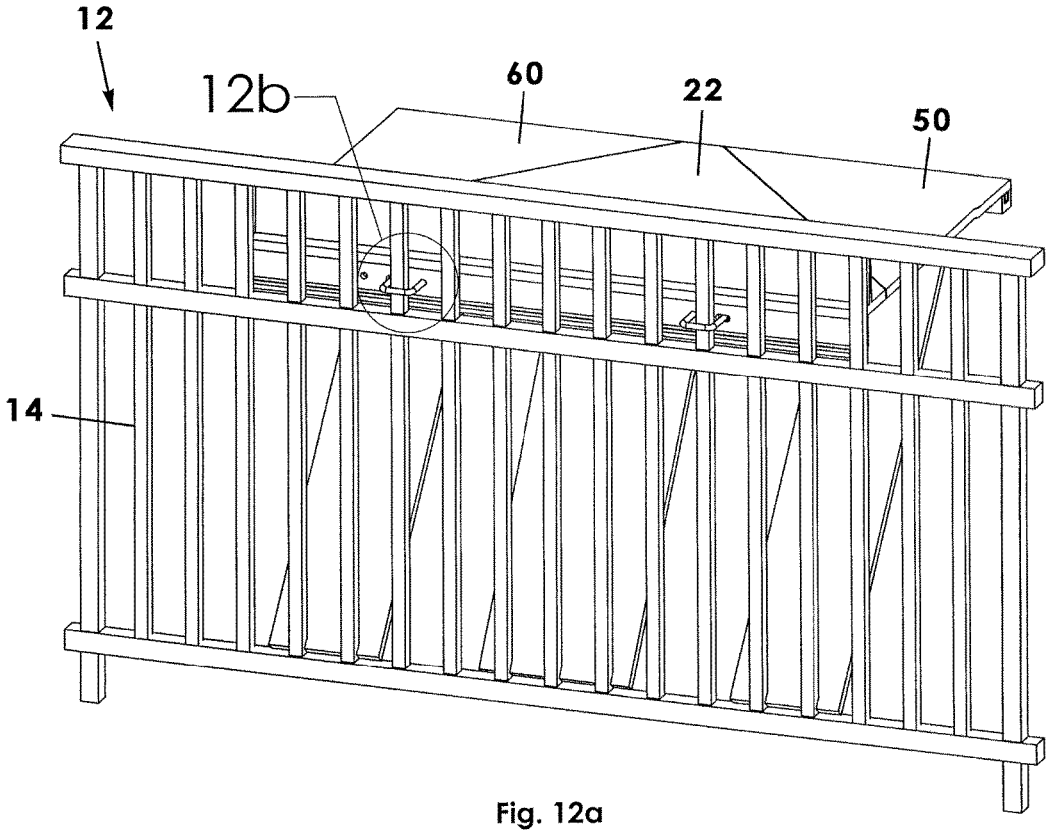
FIG. 12*a* is a rear perspective view of the balcony table according to the present invention mounted to a rail assembly.
Figure 12B:
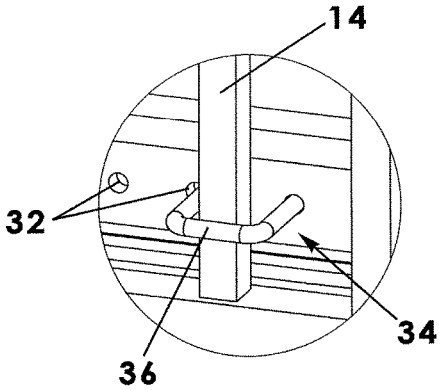
FIG. 12*b* is an isolated view on an enlarged scale taken from FIG. 12*a*.
Figure 13:
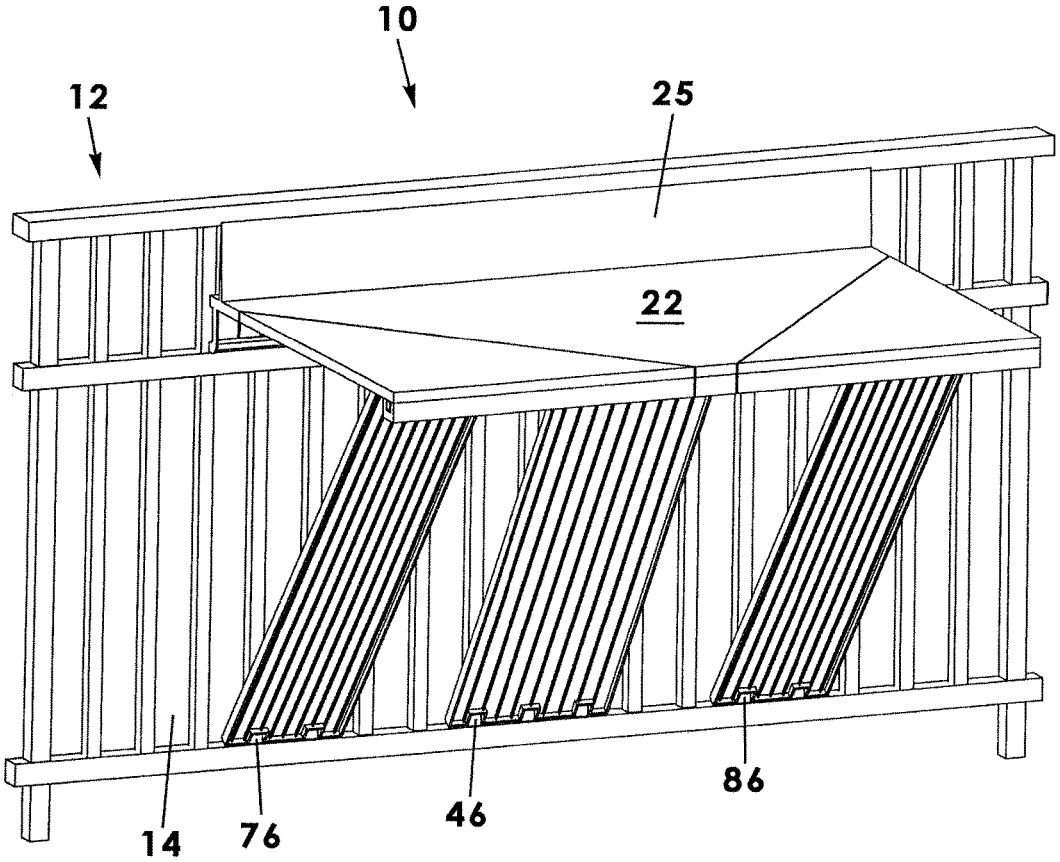
FIG. 13 is a front elevated perspective view of the balcony table as in FIG. 1.

The transformable balcony table 10 includes a fastener 34 suitable to releasably couple the mounting portion 30 to upstanding bars 14 of a balcony rail assembly 12. In an embodiment, the fastener 34 may be a U-bolt fastener having first and second arms connected at one end by a bridge 36, the first and second arms having a threaded configuration and terminal or free ends. The fastener 34 includes respective locking members 38, such as a wing nuts or the like, configured to secure the free ends of the U-bolt to a selected object. In use, the terminal ends may be inserted through the space between the vertical bars 14 of the balcony rail assembly 12 and through corresponding holes 32 of the mounting portion 30 and then secured by the locking members 38 (FIGS. 4*b* and 12*b*).

The transformable balcony table 10 includes a first stability member 40 configured to support the primary table assembly 20 above a floor surface of a balcony. It is understood that the first stability member 40 is unlike a traditional upstanding leg of a table. Namely, the first stability member 40 includes a relatively thin, flat, and elongate configuration. The first stability member 40 has a proximal end 42 releasably coupled to a bottom surface of the tabletop 22 and extends downwardly and rearwardly to a distal end 44. The distal end 44 defines one or more spaced apart slots 46 configured to engage lower ends of upstanding bars of the balcony rail assembly 12, i.e. to provide leverage and support to the tabletop 22 and primary table assembly 20. This configuration is especially advantageous considering the angle of the first stability member 40—extending upwardly and forwardly from the base of the rail assembly 12 to a selected primary stop member 48 of the tabletop 22 as described below, thereby supporting the tabletop 22 in a horizontal, level, and stable configuration.

Correspondingly, a plurality of primary stop members 48 is spaced apart and mounted to the bottom surface of the tabletop 22. In an embodiment, a respective primary stop member 48 may extend longitudinally between the side edges of the tabletop 22. Each primary stop member 48 is configured to receive the proximal end 42 of the first stability member 40 in a friction fit or nested relationship, the primary stop member 48 acting as a stop to prevent the proximal end 42 from slipping or sliding forwardly. Instead, the primary stop member 48 enables the distal end 44 of the primary stability member 48 to extend rearwardly into selective engagement with a respective bar 14 of the rail assembly 12. Conversely, the proximal end 42 of the first stability member 40 is prevented or "stopped" from sliding toward the apex 28. Therefore, when the primary table assembly 20 is mounted to a balcony rail assembly 12, the first stability member 40 is a leveraged support member. As can be seen in the figures, a plurality of primary stop members 48 may be arranged in spaced apart rows such that the proximal end 42 of the first stability member 40 may be positioned or received by a selective primary stop member 48 as would be appropriate to support the tabletop 22 in a horizontal position.

In an embodiment, a first leaf 50 and a second leaf 60 may be coupled to side edges 26 of the tabletop 22 in a manner that increases the number of eating stations from two to four as will be explained below. The first leaf 50 and the second leaf 60 each include an outside edge 52, 62 and front edge 54, 64, respectively. It is these edges that, collectively, define four eating stations in the manner of a four sided square or rectangular table.

The leaves may be releasably and removably coupled to respective side edges 26 of the tabletop 22 of the primary table assembly 20 using tongue and groove fastening structures. For instance, a mounting edge of the first leaf 50 may include an outwardly extending flange or "tongue" 56 while a side edge 26 of the tabletop 22 may define a channel, recess, or "groove" 29, the tongue and groove having configurations that are complementary to one another so as to create a friction fit engagement and one that allows a respective leaf to be released with gentle, but intentional, pulling force. Similarly, the second leaf 60 includes a tongue 66.

In substantially the same manner as described previously, a plurality of auxiliary stop members 58 may be coupled to a bottom side of the first leaf 50 and of a second leaf 60, respectively, and configured to receive a proximal end 72 of a second stability member 70 and a proximal end 82 of a third stability member 80, respectively. The second stability member 70 and the third stability member 80 may also include distal ends 74, 84 respectively, opposite respective proximal ends 72, 82, each distal end defining one or more slots 76, 86 configured to engage a bar 14 of the rail assembly 12. As described above, a respective proximal end 72, 82 of a respective auxiliary stability member may be nested or propped against a selected one of the plurality of auxiliary stop members 58 and a respective distal end 74, 84 engaged with a respective bar of the rail assembly 12 such as will keep the tabletop 22 and leaves in a horizontal and level configuration. Each distal end 74, 84 defines slots 76, 86, respectively configured to selectively engage bars 14 of balcony rail assembly 12.

In another aspect, a primary locking block 90 is coupled to the tabletop 22, such as downwardly adjacent therefrom or to a bottom of the apex 28. The primary locking block 90 may define a bore 92 longitudinally therethrough (which may also be referred to as a throughbore). Further, a pair of auxiliary locking blocks 96 is coupled to the front edges of the first leaf 50 and second leaf 60, respectively. Each auxiliary locking block 96 defines a longitudinal bore 98 therethrough. The auxiliary locking blocks 96 may also extend downwardly and the primary locking block 90 is sandwiched therebetween and all of the bores being positioned in alignment and communication with one another.

A locking rod 100 having an elongate configuration is configured to be selectively received by the bores of the primary and auxiliary locking blocks, respectively. It is understood that when the first leaf 50 and second leaf 60 are coupled to the tabletop 22 of the primary table assembly 20 and the locking rod 100 is slidably inserted through respective bores, the leaves are securely coupled to the tabletop 22.

In use, users of the transformable balcony table 10 may choose whether to install the two-station form or the four-station form of the apparatus. First, the primary table assembly 20 may be positioned with the mounting portion 30 adjacent to or in contact with the bars 14 of a rail assembly 12. The first stability member 40 may be leveraged between a bar 14 of the rail assembly 12 and an appropriate primary stop member 48 on the bottom of the tabletop 22 such that the tabletop 22 is positioned in a level configuration. Then, one or more fasteners 34 may be installed relative to the mounting portion 30 and respective bars 14 and tightened to secure the primary table assembly 20 to the rail assembly 12. If more seating stations are desired, the first leaf 50 and second leaf 60 may be coupled to the opposing side edges 26 of the tabletop 22 as described above.

It is understood that while certain forms of this invention have been illustrated and described, it is not limited thereto except insofar as such limitations are included in the following claims and allowable functional equivalents thereof.

The invention claimed is:

1. A transformable balcony table capable of attachment to a balcony rail, comprising:

a primary table assembly including a table top having a rear edge and a pair of side edges extending forwardly from said rear edge so as to form an apex opposite said rear edge, said primary table assembly including a mounting portion extending downwardly from said rear edge of said table top and defining a plurality of holes;

a first stability member having a proximal end removably coupled to said bottom surface and extending downwardly and rearwardly to a distal end;

a fastener selectively inserted through the balcony rail and through said holes of said mounting portion so as to couple said mounting portion to the balcony rail;

wherein said table top includes a top surface having a horizontal and planar configuration and includes an opposed bottom surface extending between said rear edge and said pair of side edges.

2. The transformable balcony table as in claim 1, further comprising a plurality of stop members spaced apart along said bottom surface of said table top, each stop member configured to selectively receive said proximal end of said first stability member and to prevent forward movement thereof toward said apex.

3. The transformable balcony table as in claim 2, wherein each stop member has an elongate configuration that extends along said bottom surface between opposed side edges of said table top.

4. The transformable balcony table as in claim 1, wherein said primary table assembly includes a backsplash portion extending upwardly from said rear edge of said table top.

5. The transformable balcony table as in claim 1, wherein said table top includes a generally triangular configuration that defines two eating stations along said pair of side edges, respectively.

6. The transformable balcony table as in claim 1, wherein said fastener is a U-bolt assembly having first and second arms connected by a bridge, each of said first and second arms having a free end selectively inserted through holes of said mounting portion, said U-bolt assembly having a locking member configured to secure respective free ends of said first and second arms to the balcony rail once inserted through selected holes.

7. The transformable balcony table as in claim 1, further comprising:

a first leaf releasably coupled to one of said pair of side edges of said table top;

a second leaf releasably coupled to another of said pair of side edges of said table top;

wherein said first leaf and said second leaf include generally rectangular configurations having outside edges and front edges, respectively.

8. The transformable balcony table as in claim 7, wherein said front edges and said outside edges of said first leaf and said second leaf, respectively, define four eating stations atop said first leaf, said second leaf, and said table top, collectively.

9. The transformable balcony table as in claim 7, wherein said first leaf and said second leaf are releasably coupled to said side edges of said table top, respectively, in a tongue and groove relationship.

10. The transformable balcony table as in claim 7, comprising:

a primary locking block coupled to said table top downwardly adjacent said apex, said primary locking block defining a primary bore extending longitudinally therethrough;

a pair of auxiliary locking blocks coupled to said front edges of said first leaf and said second leaf, respectively, said pair of auxiliary locking blocks defining an auxiliary bore extending longitudinally therethrough and in communication with said through bore of said primary locking block; and a locking rod having an elongate configuration selectively inserted through said pair of auxiliary bores and said primary bore so as to secure said first leaf and said second leaf to said primary table assembly;

wherein said primary locking block is sandwiched between said pair of auxiliary locking blocks.

11. The transformable balcony table as in claim 7, further comprising:

a second stability member having a proximal end removably coupled to a bottom surface of said first leaf and extending downwardly and rearwardly to a distal end;

a third stability member having a proximal end removably coupled to a bottom surface of said first leaf and extending downwardly and rearwardly to a distal end.

12. The transformable balcony table as in claim 7, further comprising a plurality of auxiliary stop members spaced apart along said bottom surface of said first leaf and said second leaf, each auxiliary stop member being configured to selectively receive said proximal end of said second stability member and said proximal end of said third stability member and to prevent forward movement thereof toward respective front edges.

13. The transformable balcony table as in claim 12, further comprising:

a plurality of stop members spaced apart along said bottom surface of said table top, each stop member configured to selectively receive said proximal end of said first stability member and to prevent forward movement thereof toward said apex;

a plurality of auxiliary stop members spaced apart along said bottom surface of said first leaf and said second leaf, each auxiliary stop member being configured to selectively receive said proximal end of said second stability member and said proximal end of said third stability member and to prevent forward movement thereof toward respective front edges.

14. A transformable balcony table capable of attachment to a balcony rail, comprising:

a primary table assembly including a table top having a rear edge and a pair of side edges extending forwardly from said rear edge so as to form an apex opposite said rear edge, said primary table assembly including a mounting portion extending downwardly from said rear edge of said table top and defining a plurality of holes;

a first stability member having a proximal end removably coupled to said bottom surface and extending downwardly and rearwardly to a distal end;

a fastener selectively inserted through the balcony rail and through said holes of said mounting portion so as to couple said mounting portion to the balcony rail;

wherein said table top includes a top surface having a horizontal and planar configuration and includes an opposed bottom surface extending between said rear edge and pair of side edges;

a first leaf releasably coupled to one of said pair of side edges of said table top;

a second leaf releasably coupled to another of said pair of side edges of said table top;

wherein said first leaf and said second leaf include generally triangular configurations having outside edges and front edges, respectively.

15. The transformable balcony table as in claim 14, wherein said primary table assembly includes a back splash portion extending upwardly from said rear edge of said table top.

16. The transformable balcony table as in claim 14, wherein said table top includes a generally triangular configuration that defines two eating stations along said pair of side edges, respectively.

17. The transformable balcony table as in claim 14, wherein said fastener is a U-bolt assembly having first and second arms connected by a bridge, each of said first and second arms having a free end selectively inserted through holes of said mounting portion, said U-bolt assembly having a locking member configured to secure respective free ends of said first and second arms to the balcony rail once inserted between bars of the rail assembly and through respective holes.

18. The transformable balcony table as in claim 14, wherein said front edges and said outside edges of said first leaf and said second leaf, respectively, define four eating stations atop said first leaf, said second leaf, and said table top, collectively.

19. The transformable balcony table as in claim 14, wherein said first leaf and said second leaf are releasably coupled to said side edges of said table top, respectively, in a tongue and groove relationship.

20. The transformable balcony table as in claim 14, comprising:

a primary locking block coupled to said table top downwardly adjacent said apex, said primary locking block defining a primary bore extending longitudinally therethrough;

a pair of auxiliary locking blocks coupled to said front edges of said first leaf and said second leaf, respectively, said pair of auxiliary locking blocks defining an auxiliary bore extending longitudinally therethrough and in communication with said through bore of said primary locking block; and a locking rod having an elongate configuration selectively inserted through said pair of auxiliary bores and said primary bore so as to secure said first leaf and said second leaf to said primary table assembly;

wherein said primary locking block is sandwiched between said pair of auxiliary locking blocks.

* * * * *